US011149381B2

(12) United States Patent
Sargent et al.

(10) Patent No.: US 11,149,381 B2
(45) **Date of Patent: *Oct. 19, 2021**

(54) NON-FLUORINATED FIBER AND TEXTILE TREATMENT COMPOSITIONS AND APPLICATIONS THEREOF

(71) Applicant: WILANA CHEMICAL LLC, Rome, GA (US)

(72) Inventors: Ralph R. Sargent, Rome, GA (US); Dennis J. Jones, Jr., Signal Mountain, TN (US)

(73) Assignee: WILANA CHEMICAL LLC, Rome, GA (US)

( * ) Notice: Subject to any disclaimer, the term of this patent is extended or adjusted under 35 U.S.C. 154(b) by 227 days.

This patent is subject to a terminal disclaimer.

(21) Appl. No.: 16/190,957

(22) Filed: Nov. 14, 2018

(65) Prior Publication Data

US 2019/0145046 A1 May 16, 2019

Related U.S. Application Data

(60) Provisional application No. 62/586,017, filed on Nov. 14, 2017.

(51) Int. Cl.

| | |
|---|---|
| ***D06P 3/24*** | (2006.01) |
| ***D06M 13/425*** | (2006.01) |
| ***D06M 15/41*** | (2006.01) |
| ***D06P 1/649*** | (2006.01) |
| ***D06M 13/507*** | (2006.01) |
| ***D06P 1/52*** | (2006.01) |
| ***D06M 13/435*** | (2006.01) |
| ***D06M 101/36*** | (2006.01) |
| ***D06M 101/34*** | (2006.01) |

(52) U.S. Cl.

CPC ..... *D06P 3/241* (2013.01); *D06M 13/425* (2013.01); *D06M 13/435* (2013.01); *D06M 13/507* (2013.01); *D06M 15/41* (2013.01); *D06P 1/5292* (2013.01); *D06P 1/6492* (2013.01); *D06M 2101/34* (2013.01); *D06M 2101/36* (2013.01); *D06M 2200/01* (2013.01); *D06M 2200/10* (2013.01)

(58) Field of Classification Search

CPC ..... D06M 13/425; D06M 13/435; D06M 13/507; D06M 15/41; D06M 2101/34; D06M 2101/36; D06M 2200/01; D06M 2200/10; D06P 1/5292; D06P 1/6492; D06P 3/241

See application file for complete search history.

(56) References Cited

U.S. PATENT DOCUMENTS

| | | | | |
|---|---|---|---|---|
| 4,780,099 | A | 10/1988 | Greschler et al. | |
| 4,937,123 | A | 6/1990 | Chang et al. | |
| 5,212,272 | A | 5/1993 | Sargent et al. | |
| 6,238,745 | B1 | 5/2001 | Morita et al. | |
| 8,057,693 | B1 | 11/2011 | Ford et al. | |
| 2008/0096001 | A1 | 4/2008 | Emden et al. | |
| 2008/0282480 | A1 | 11/2008 | Hu et al. | |
| 2016/0108577 | A1 * | 4/2016 | Gulati | D06M 15/568 8/116.1 |

FOREIGN PATENT DOCUMENTS

| | | | | |
|---|---|---|---|---|
| CN | 105220505 A | * | 1/2016 | A61K 8/88 |
| WO | WO-2015145100 A1 | * | 10/2015 | A61K 8/88 |

OTHER PUBLICATIONS

Ghosh, "Coating on Viscose-Poor Wet Strength of Viscose can be improved by the Application of Chemical Finishes like Water Repellent and Soil Release Finishes", International Journal of Engineering & Technology, vol. 11 Issue 5 (Oct. 2011): pp. 68-73 (Year: 2011).*

European extended search report, application No. 18877387.3, dated Aug. 9, 2021, 4 pages.

International Search Report and Written Opinion corresponding to PCT/US2018/061032, dated Feb. 4, 2019, 15 pages.

* cited by examiner

*Primary Examiner* — Anthony J Green

(74) *Attorney, Agent, or Firm* — J. Clinton Wimbish; Nexsen Pruet, PLLC

(57) ABSTRACT

In one aspect, a composition for treating fibers comprises an acidic aqueous or aqueous-based continuous phase and a liquid repellent phase comprising a dendrimer component and/or non-dendrimer alkyl urethane. The treatment composition, for example, can have pH of 2.5 to 6.5. In some embodiments, carboxylic acid is employed in the treatment composition for providing the acidic character of the aqueous or aqueous-based continuous phase. Moreover, the treatment composition can further comprise at least one of an acid stain resist component and soil release component. In some embodiments, fibers treated with compositions described herein exhibit ionic character.

34 Claims, No Drawings

NON-FLUORINATED FIBER AND TEXTILE TREATMENT COMPOSITIONS AND APPLICATIONS THEREOF

RELATED APPLICATION DATA

The present application claims priority pursuant to 35 U.S.C. § 119(e) to U.S. Patent Application Ser. No. 62/586,017 filed Nov. 14, 2017, which is incorporated herein by reference in its entirety.

FIELD

The present invention relates to fiber and textile treatment compositions and, in particular, to treatment compositions free of a fluorochemical component.

BACKGROUND

Manufactures of textiles are continuously searching for compositions to enhance textile fiber performance and durability. In the carpet and floor coverings industry, for example, manufacturers desire compositions operable to render carpet fibers resistant to liquids and discoloration caused by soil accumulation. Fluorinated or perfluorinated alkyl compounds, when applied to fibers in sufficient amount, lower the surface energy of the fiber or fabric below the surface tension of water or oils that might be spilled onto the fabric. This allows these liquids to be removed before they can penetrate into the fiber or fabric. This is of great benefit for fibers and fabrics used in residential, commercial and industrial settings as the useful life of the fibers and fabric is substantially increased.

Recently, fluorinated and perfluorinated compounds have come under increased scrutiny for various environmental concerns, including bioaccumulation in aquatic environments. In view of these concerns, textile manufacturers desire fiber treatment compositions less reliant on fluorinated compounds. However, to date, non-fluorinated fiber treatment compositions significantly underperform their fluorinated counterparts for liquid repellency.

SUMMARY

In view of these considerations, fiber and textile treatment compositions are described herein free of fluorinated or perfluorinated compounds. Such non-fluorinated treatment compositions can exhibit liquid repellency performance comparable to, or surpassing fluorinated treatment compositions, in some embodiments. Moreover, non-fluorinated treatment compositions described herein can be applied to fibers and textiles via exhaustion-heat fixation techniques. Unlike spray and foam techniques, exhaustion-heat fixation techniques can apply the treatment composition over the entire fiber length or a substantial portion of fiber length.

In one aspect, a composition for treating fibers comprises an acidic aqueous or aqueous-based continuous phase and a liquid repellent phase comprising a dendrimer component and/or non-dendrimer alkyl urethane. The treatment composition, for example, can have pH of 2.5 to 6.5. In some embodiments, carboxylic acid is employed in the treatment composition for providing the acidic character of the aqueous or aqueous-based continuous phase. Moreover, the treatment composition can further comprise at least one of an acid stain resist component and soil release component. In some embodiments, fibers treated with compositions described herein exhibit ionic character.

In another aspect, textile compositions are described. A textile composition comprises fibers having a treatment composition applied to fiber surfaces, the treatment composition comprising an acid stain resist component and a liquid repellent phase including a dendrimer component and/or non-dendrimer alkyl urethane. In some embodiments, the treatment composition applied to fiber surfaces further comprises a soil release component. Fibers having the treatment composition applied thereto can comprise ionic moieties or exhibit ionic character, in some embodiments. In such embodiments, the minimum requirement of the treatment composition is the liquid repellent phase comprising one or more dendrimers.

In a further aspect, methods of treating fibers are described. A method of treating fibers comprises providing a treatment composition comprising an acidic aqueous or aqueous-based continuous phase and a liquid repellent phase comprising a dendrimer component and/or non-dendrimer alkyl urethane. Fiber surfaces are wetted with the treatment composition. In some embodiments, the treatment composition completely wets the fibers in the application process. Once wetted, the fibers can be heated to exhaust the liquid repellent phase onto the fibers from the treatment composition.

As described herein, the treatment composition can further comprise at least one of an acid stain resist component and soil release component. Additionally, the fibers can comprise ionic moieties or ionic character, in some embodiments.

These and other embodiments are further described in the following detailed description.

DETAILED DESCRIPTION

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Fiber Treatment Compositions

In one aspect, a composition for treating fibers comprises an acidic aqueous or aqueous-based continuous phase and a liquid repellent phase comprising a dendrimer component and/or non-dendrimer alkyl urethane. The treatment composition, for example, can have pH of 2.5 to 6.5. In some embodiments, pH of the treatment composition can have a value selected from Table I.

TABLE I

| Fiber Treatment Composition pH |
|---|
| 2.5-6.5 |
| 3-6 |
| 2.5-5.5 |
| 2.5-4 |
| 2.7-3.7 |
| 3-4 |

pH of the treatment composition can be controlled or set by one or more acids. Any acid operable to provide the desired pH and compatible components of the treatment composition can be employed. In some embodiments, acid of the treatment composition comprises one or more carboxylic acids or carboxylic acid derivatives. For example, a treatment composition can comprise acetic acid or acetic acid derivative. In some embodiments, acid of the treatment composition can be an alkyl or aryl carboxylic acid. Alkyl carboxylic acid can include primary, secondary and tertiary carboxylic acid. Acid can be present in the treatment composition in any amount required to provide the desired pH. Carboxylic acid, including acetic acid, can be present in the treatment composition in an amount of 0.2 to 2% on weight fiber, in some embodiments.

The liquid repellent phase can comprise any dendrimer not inconsistent with the objectives of the present invention. In some embodiments, suitable dendrimers comprise hydrophobic terminal residues. Hydrophobic terminal residues can include alkyl or alkenyl residues, such as methyl or ethyl moieties. Hydrophobic terminal residues can self-assemble into a hydrocarbon matrix during heat treatment, such as heat fixation techniques described further herein. This self-assembly can induce ordered co-crystallization to provide desirable liquid repellent properties. In some embodiments, dendrimer branches comprise one or more polyurethanes of polyurethane derivatives. In other embodiments, dendrimer of the liquid repellent phase comprises isocyanates as cross-linking agents and $C_6$-$C_{20}$-alkyl groups containing organopolysiloxane. Dendrimer of the liquid repellent phase, in some embodiments, exhibits ionic character or behavior. For example, dendrimer may exhibit cationic or anionic character. Dendrimer having ionic character can be chosen with respect to ionic character of the fibers to be treated. In this way, dendrimer may associate with the fibers via ionic interactions and/or van der Waals interactions. For example, dendrimer having cationic character can be employed with fibers having anionic character, such as cationic dyeable nylon.

Depending on specific compositional identity, dendrimer may be dispersed in the acidic aqueous or acidic aqueous-based phase to provide an emulsion or colloid. Alternatively, dendrimer may be dissolved in the aqueous or aqueous-based continuous phase. In some embodiments, dendrimer of the liquid repellent phase is commercially available from the Rudolf Group of Altvaterstr, Germany under the RUCO-DRY® trade designation.

As described herein, the liquid repellent phase, in some embodiments, comprises non-dendrimer alkyl urethane. Non-dendrimer alkyl urethane can be the sole component of the liquid repellent phase. Alternatively, non-dendrimer alkyl urethane can be present with one or more additional components to form the liquid repellent phase. In some embodiments, non-dendrimer alkyl urethane can be present in conjunction with dendrimer. Non-dendrimer alkyl urethane is commercially available from Huntsman Corporation of the Woodlands, Tex. under the Zelan™ R3 trade designation.

One or more dendrimers can be present in the treatment composition in any amount not inconsistent with the objectives of the present invention. Amount of dendrimer in the treatment composition can be selected according to several considerations including, but not limited to, desired liquid repellency, exhaustibility of the dendrimer onto fiber surfaces, stability of the treatment compositions and identity of other chemical species included in the treatment composition. In some embodiments, one or more dendrimers are present in the treatment composition in an amount of 0.1 to 6% on weight fiber (owf). Dendrimer component may also be present in the treatment composition in an amount selected from Table II.

TABLE II

| Amount of Dendrimer Component (% owf) |
|---|
| 0.5-6 |
| 0.3-5 |
| 0.5-3 |
| 0.5-2.5 |
| 0.5-2 |
| 0.1-1 |
| 0.5-1.5 |
| 0.5-1 |
| 1-3 |
| 2-4 |
| 2-3 |

Similarly, non-dendrimer alkyl urethane can be present in the treatment composition in an amount of 0.1 to 6% owf. In other embodiments, non-dendrimer alkyl urethane can be present in the treatment composition in an amount selected from Table II.

Fiber treatment compositions described herein can comprise one or more components in addition to the liquid repellent phase. In some embodiments, the fiber treatment composition further comprises an acid stain resist component. Any acid stain resist component not inconsistent with the objectives of the present invention can be employed. Acid stain resist species can be generally anionic in character, in some embodiments. In some embodiments, acid stain resist component comprises chemical species based on phenol-formaldehyde condensation products. By having anionic character, the acid stain resist component can interact with fibers having cationic character or moieties, such as various nylon compositions. In some embodiments, the acid stain resist component can alter a cationic fiber to a fiber having anionic character. In such embodiments, dendrimer having cationic character can associate with the anionic fiber, thereby providing liquid repellency in addition to acid stain resistance. Acid stain resist component can be present in the fiber treatment composition in any desired amount. Amount of acid stain resist component can be selected according to several considerations including, but not limited to, stability of the treatment composition, compositional nature of the fibers to be treated and compatibility with other components of the treatment composition. In some embodiments, acid stain resist component is present in the fiber treatment composition in an amount of 0.5 to 6% owf. Acid stain resist may also be present in the treatment composition in an amount selected from Table III.

TABLE III

| Amount of Acid Stain Resist (% owf) |
|---|
| 0.5-5 |
| 1-4 |
| 2-3 |
| 3-5 |
| 2-4.5 |

Fiber treatment compositions may also comprise a soil release component in addition to the liquid repellent phase. In some embodiments, soil release component is present in conjunction with liquid repellent phase and acid stain resist component. Soil release component can comprise one or more hydrophilic species demonstrating soil release properties. Hydrophilic species can include cationic, anionic or non-ionic polymeric species in some embodiments. In other embodiments, soil release component can comprise orthosilicates or alkoxysilanes, such as tetraethoxysilane. Soil release component can be present in the treatment composition in any desired amount. Amount of acid soil release component can be selected according to several considerations including, but not limited to, stability of the treatment composition, compositional nature of the fibers to be treated and compatibility with other components of the treatment composition. In some embodiments, soil release component is present in the fiber treatment composition in an amount of 0.05 to 6% owf. Soil release component may also be present in the treatment composition in an amount selected from Table IV.

TABLE IV

| Amount of Soil Release Component (% owf) |
|---|
| 1-5 |
| 2-4 |
| 3-6 |
| 1-3 |

Fiber treatment compositions may also comprise UV absorbers, surfactant(s) and/or other components in addition to dendrimer liquid repellent phase, acid stain resist component, soil release component and/or acid. In some embodiments, treatment compositions further comprise one or more amines, such as amine ethoxylates. Suitable amine ethoxylates can include TAM 15 or TAM 20. Amine can generally be present in the treatment composition at a concentration of 0.5-2 g/L.

Acid of the treatment composition can serve as a compatibilizer between various components of the treatment composition. In some embodiments, acid serves as a compatibilizer between dendrimer and/or non-dendrimer alkyl urethane of the liquid repellent phase and the acid stain resist and/or soil release components. Alkyl carboxylic acid, such as acetic acid, can inhibit or preclude destabilizing interaction(s) between the dendrimer component or non-dendrimer alkyl urethane and various chemical species of the acid stain resist and/or soil release components. As described herein, dendrimer, non-dendrimer alkyl urethane, acid stain resist and/or soil release chemical species can exhibit ionic character. Acid of the treatment composition can inhibit or preclude ionic and/or van der Waals interactions between the dendrimer component or non-dendrimer alkyl urethane and the stain resist and/or soil release components, thereby avoiding agglomeration or precipitation of these components. Moreover, acid provides the treatment composition a pH selected from Table I hereinabove. It has been found that acid providing a pH selected from Table I exhibits sufficient ionic character to stabilize components of the treatment composition while being sufficiently acidic to drive components of the treatment composition onto fibers via exhaustion bath techniques. Moreover, the acid can exhibit suitable vapor pressure for rapid evaporation at drying temperatures recited herein, resulting in desirable film formation of treatment composition components on the fibers.

Treatment compositions described herein can be applied to a variety of fibers, including natural and synthetic fibers. In some embodiments, fibers comprise nylon, including cationic nylons and acid-dyeable nylons. Nylon fibers include nylon-6 and nylon-6,6. In other embodiments, synthetic fibers comprise polyolefin fibers, polyesters, polyethylene terephthalate (PET) and polytrimethylene terephthalate (PTT).

In some embodiments, a treatment composition described herein comprises a dendrimer component or non-dendrimer alkyl urethane in an amount of 10-20 wt. %, orthosilicate in an amount of 40-60 wt. % and the balance acetic acid solution (56%).

II. Textile Compositions

In another aspect, textile compositions are described. A textile composition comprises fibers having a treatment composition applied to fiber surfaces, the treatment composition comprising an acid stain resist component and a liquid repellent phase including a dendrimer component and/or non-dendrimer alkyl urethane. In some embodiments, the treatment composition applied to fiber surfaces further comprises a soil release component. Fibers having the treatment composition applied thereto can comprise ionic moieties or exhibit ionic character, in some embodiments. In such embodiments, the minimum requirement of the treatment composition is the liquid repellent phase comprising one or more dendrimers and/or non-dendrimer alkyl urethane. Treatment compositions applied to fibers of textiles can have any composition and/or properties described in Section I hereinabove.

Additionally, fibers of the textile composition can comprise a variety of compositions and properties. As described herein, fibers of the textile composition exhibit ionic character. Fibers can exhibit cationic character or anionic character. Ionic character of the fibers can be used to form or enhance interactions with one or more components of the treatment composition. In some embodiments, ionic character of the fiber forms ionic interactions and/or van der Waals interactions with dendrimer of the liquid repellent component. For example, anionic character of the fibers can form ionic and/or van der Waals interactions with dendrimer having cationic character. In some embodiments, monomeric units forming the fiber comprise anionic and/or cationic moieties. Amine groups of nylon fibers, for instance, can provide cationic character. In other embodiments, fibers can be chemically modified to contain the desired cationic or anionic moieties. Amine functionalities of nylon fibers can be chemically modified with sulfo-groups or other anionic groups to impart anionic character. Cationic nylon fibers are examples where such modification has taken place. Alternatively, acid stain resist component can interact with amine functionalities of nylon fibers to impart anionic character to the fibers. In further embodiments, exposure of acid dyeable fibers to a high pH bath can provide the fibers with anionic charge or character. Exposure to the high pH bath can occur during the dye fixation process. For nylon fibers, the normal cationic character for amine end groups can be neutralized or turned anionic in the high pH bath conditions, in some embodiments. With anionic character established by chemical modification, presence of acid stain resist and/or exposure to high pH conditions during dyeing, the nylon fibers can form ionic and/or van der Waals interactions with dendrimer having cationic character. These principles are further illustrated in the examples below.

Fiber surfaces comprising the treatment composition can extend any distance along the fiber length. In some embodiments, fiber surfaces comprising the treatment composition extend at least 50 percent of fiber length. In other embodiments, fiber surfaces comprising the treatment composition extend over the entire fiber length. Additional distances over which fiber surfaces comprising the treatment composition extend can be selected from Table V.

TABLE V

| % of Fiber Length Treated |
|---|
| ≥60 |
| ≥70 |
| ≥75 |
| ≥80 |
| 50-95 |
| 50-90 |
| 50-85 |
| <50 |

Treatment compositions described herein can be applied to a variety of fibers, including natural and synthetic fibers. In some embodiments, fibers comprise nylon, including cationic nylons and acid-dyeable nylons. Nylon fibers include nylon-6 and nylon-6,6. In other embodiments, synthetic fibers comprise polyolefin fibers, polyesters, polyethylene terephthalate (PET) and polytrimethylene terephthalate (PTT).

Textile compositions comprising fibers having treatment compositions applied thereto include floor coverings, such as rugs and carpets. Textile compositions can also comprise articles of clothing, upholstery, curtains, bedding and other furniture fabrics.

Fibers treated with compositions described in Section I herein can exhibit desirable liquid repellency, stain resistant and soil resistant properties. In some embodiments, for example, the treated fibers score at least an 8 on the 10 point America Association of Textile Chemists and Colorists (AATCC) Red 40 Stain Scale. Treated fibers can also exhibit a score of 9 or 10 on the AATCC Red 40 Stain Scale. Moreover, for floor covering applications, fibers treated with compositions of Section I can exhibit at least a 20 percent change in DL* relative to the untreated control according to ASTM D6540-17 Standard Test Method for Accelerated Soling Pile Yarn Floor Covering. In some embodiments, percent change in DL* between treated and untreated fiber compositions can range from 20 to 50 percent.

Regarding liquid repellency, floor covering compositions comprising fibers treated with a composition of Section I can display a value of at least 50 in the float test. In the float test, a section of floor covering, such as carpet, is prepared, such as 2 inches by 2 inches. The carpet is subsequently placed on the surface of a water bath. The carpet can be placed on the water surface in a 'pile up' (PU) conformation or a 'pile down' (PD) conformation. The carpet is left on the water surface for a period of two minutes. A value of 0 in the float test indicates that the entire carpet sample remained floating on the water surface after the expiration of two minutes. A value of 100 indicates the entire carpet sample wet out before expiration of two minutes and sank below the water surface. A value of 50 indicates 50 percent of the carpet sample was below the water surface after two minutes exposure to the water bath. Carpet comprising fibers treated with compositions described in Section I can exhibit a maximum value of 50 in the float test in the PU and/or PD conformation. In many cases, carpet comprising the treated fibers achieves a float test value of 0 in the PU and/or PD conformation. Notably, treatment compositions of Section I can simultaneously provide fibers with stain resistance, soil resistance and liquid repellency performance described in this Section II.

III. Methods of Treating Fibers

In a further aspect, methods of treating fibers are described. A method of treating fibers comprises providing a treatment composition comprising an acidic aqueous or aqueous-based continuous phase and a liquid repellent phase comprising a dendrimer component and/or non-dendrimer alkyl urethane. Fiber surfaces are wetted with the treatment composition. In some embodiments, the treatment composition completely wets the fibers in the application process. Once wetted, the fibers can be heated to exhaust the liquid repellent phase onto the fibers from the treatment composition. As described herein, the treatment composition can further comprise at least one of an acid stain resist component and soil release component. Additionally, the fibers can comprise ionic moieties or ionic character, in some embodiments.

Treatment compositions applied to textile fibers for improving or enhancing liquid repellency, stain resistance and/or soil resistance can have any of the compositional parameters and/or properties described in Section I hereinabove. Dendrimer, non-dendrimer alkyl urethane, acid stain resist component and/or soil release component can be present in the treatment composition in any of the respective amounts provided in Tables II-IV above. Additionally, pH of the treatment composition can have a value selected from Table I above, wherein pH is set by one or more acids. In some embodiments of methods described herein, components of the treatment composition (dendrimer component or non-dendrimer alkyl urethane, acid stain resist and/or soil release components) are blended into a single mixture for application to fiber surfaces. In other embodiments, components of the treatment composition can be separated into two or more sub-treatment compositions for application to fiber surfaces. For example, acid stain resist component can be initially applied to fiber surfaces in a sub-treatment composition. Initial application of acid stain resist component can provide the fibers anionic character. Dendrimer of cationic character is subsequently applied in a second sub-treatment composition. The second sub-treatment composition can also comprise soil release component. In other embodiments, fiber surfaces can be provided anionic character via dying at high pH values.

Treatment compositions, including sub-treatment compositions, can be applied to the fibers via a variety of techniques. Application technique can partially or completely wet the fibers. In some embodiments, fiber length wetted by the treatment composition is selected from Table V above. Fibers, for example, can be immersed in a bath of the treatment composition to fully wet the fibers. In other embodiments, treatment compositions are applied by pad of foam application. Immersion in a treatment bath or exposure to pad application can enable wet pick of the treatment composition in a range of 30 to 600 percent. In some embodiments, wet pick up of the treatment composition is from 200 to 400 percent or 275 to 325 percent. The treatment composition is applied to the textile fibers at the desired wet pick up, and the fibers are passed through a steam heating chamber for a period of time sufficient to exhaust the components of the treatment composition on the fibers. In some embodiments, for example, steam heating is administered for a period of 1 to 10 minutes at a temperature of 90-110° C. The fibers are then rinsed, extracted and dried. When the treatment composition is divided into sub-treatment compositions, each sub-treatment composition can be applied via immersion/stream/rinse. In some embodiments, the fibers are not dried between application steps of the component subsets and only dried after application of the final component subset. Any and all subset combinations of treatment composition components are contemplated herein.

In some embodiments, the treated fibers are dried. Drying can be achieved by any technique not inconsistent with the objectives of the present invention. Drying, for example, can be administered in an oven or by blowing air over the treated fibers. In some embodiments, drying is administered at temperatures of 100 to 120° C. for a time period of 1 to 10 minutes. Drying temperatures can be selected according to several considerations including identity of the treated fibers and film forming characteristics of the treatment composition relative to evaporation rate. Fibers treated with compositions described herein can exhibit stain resistance, soil resistance and liquid repellency performance as described in Section II above.

These and other embodiments are further illustrated in the following non-limiting examples.

Example 1—Treatment and Performance of Nylon Carpets

A 40 oz/yd carpet construction, cut pile, Suessen set, using Ascend nylon 6.6 fiber, cationic dyeable, with nominal 2300 ppm sulfuer level was used for the following experiments. The carpet greige was rinsed with deionized water and extracted, prior to being contacted with the treatment baths of composition in Table VI below. The treatment baths were made up based on the % owf target levels for the components as provided in Table VI, at 350% wpu. The carpet samples were immersed into the treatment bath, using an application pan, such that the carpet sample was fully and evenly wet out with the bath. The carpet sample with the treatment composition applied was then subjected to two minutes of steaming in a horizontal steamer. After removal from the steamer, the carpet sample was rinsed using deionized water, and extracted in a centrifuge, followed by drying in a convention oven at 115° C. for five minutes. The dried sample was then allowed to cool at room temperature (23° C., 65% RH) for eight hours minimum, prior to any testing.

TABLE VI

Treatment Compositions and Testing Results

| Sample | ATFB (owf) | Acetic 56 (owf) | DSR (owf) | R3 (owf) | DL* | Decmc | AR40 | Flt PD | Flt PU |
|---|---|---|---|---|---|---|---|---|---|
| 15-2 | 1 | 2 | 4 | 2.5 | −24.27 | 9.9 | 10 | 0 | 0 |
| 15-1 | 1 | 2 | 0 | 2.5 | −23.45 | 9.95 | 10 | 0 | 0 |
| 16-4 | 0 | 0 | 0 | 0 | −20.69 | 8.26 | 1 | 100 | 100 |
| 16-2 | 1 | 2 | 4 | 1.5 | −20.65 | 8.47 | 8 | 0 | 0 |
| 17-3 | 1 | 2 | 2 | 1 | −19.51 | 7.95 | 10 | 0 | 0 |
| 16-1 | 1 | 2 | 4 | 2 | −19.41 | 8.06 | 10 | 0 | 50 |
| 15-3 | 1 | EX-2 | 0 | JA60-.5 | −19.24 | 7.93 | 1 | 60 | 60 |
| 17-4 | 0 | 0 | 0 | 0 | −19.15 | 7.4 | 1 | 100 | 100 |
| 16-3 | 1 | 2 | 4 | 1 | −16.8 | 7.05 | 8 | 0 | 0 |
| 17-1 | 1 | 2 | 4 | 0.5 | −16.48 | 6.82 | 10 | 0 | 50 |
| 17-2 | 1 | 2 | 4 | 0 | −12.92 | 5.27 | 1 | 100 | 100 |

ATFB Acid Stain Resist of Wilana Chemical of Columbus GA, based on phenol-formaldehyde condensation product(s).
Acetic 56 Acetic acid at 56% for pH adjustment
Liquid Repellent Phase Zelan ™ R3
Soli Release Component Tanapel DSR, tetraethoxysilane from Tanatex Chemicals of Ede, Netherlands.

The components of the treatment composition were mixed into an aqueous continuous phase to provide the treatment composition.

The Acid Red 40 stain resistance was determined by using the AATCC 175 test method. The soil resistance was determined by using the ASTM D6540 method, and a 7000 A colorimeter manufactured by Xrite. The float test described above was used to determine the percent sink values for the carpet sample(s) after two minutes from the time the sample was placed on the water surface. Sample 15-3 was a comparative fluoropolymer treatment composition comprising acid stain resist and $C_6$ fluoropolymer. Samples 16-4 and 17-4 are untreated controls for comparative purposes.

17-2: The data indicate that the DSR product provides excellent soil release properties when applied without the liquid repellent product, but does not provide the desired float test performance, nor does it provide the desired AR40 acid stain resistance.

15-2 and 15-1: These samples indicate that, if the liquid repellent (R3) is used at too high a level (2.5% owf in this case), the soil release properties are poor with vacuuming, and the addition of the DSR to the system does not provide any significant improvement.

16-3 and 17-1: With the DSR level of 4% owf, and the liquid repellent (R3) level in the range of 0.5% to 1.0%, the treated samples exhibited very good soil release properties, better than the fluorochemically treated control sample of 15-3. These samples also exhibit adequate AR40 stain resistance, and acceptable float test results, in either the PU or PD configuration.

Example 2—Treatment and Performance of Nylon Carpets

Ascend nylon 6.6, acid dyeable, Suessen set greige material was used. Treatment system A incorporated first a dye bath at 400% wpu, containing DOSS 70 wetting agent at 0.5% owf, and acetic acid to pH 5, along with Acid Yellow 199 at 0.004% owf. The dye bath also included stain resist ATFB from PSL, at 3.0% owf. The above bath was applied to the nylon fibers using a pan system and heated with saturated steam for 4 minutes, followed by rinsing, and extraction. A second bath was then applied using the same application system, steamed for 2 minutes, followed by rinsing, extraction and drying. This bath contained Tanapel DSR soil resist agent at 4% owf, Zealand R3 liquid repellent at 0.4% owf, acetic acid at 2% owf, and water for 350% wpu.

Comparative sample B was processed using essentially the same approach as above with the exception that the ATFB stain resist was removed from the dyebath, and added instead to the after treatment bath.

After drying, and conditioning the carpet samples, two inch by two inch samples were cut from each condition and subjected to pile down float testing as previously described. Sample A floated for two minutes with little or no wetting out of the fibers in contact with the water bath. Sample Bwhen tested the same way, sank immediately, indication poor exhaustion of the treatment bath components. , Example 3—Treatment and Performance of Nylon Carpets Experiments were set up to gauge the effect of using stain resist material in the dyebath, prior to application of the protective treatment bath containing the liquid repellent and soil resist compounds, which can exhibit be cationic character. In the examples below, Ascend acid dyeable carpet greige was used, the yarn was Suessen set into a 1400's total denier construction, and the tufting construction was 40 oz per yard.

The dyeings were performed at 450 wpu application, followed by 4 minutes steaming using saturated steam, then rinsed and extracted. The protective treatment bath was then applied using 350% wpu, followed by 2 minutes of saturated steam, then rinsed and extracted, followed by drying at 230 F for five minutes. SBR latex compound using 500 parts calcium carbonate filler loading was then applied, followed by an oven exposure of 110° C. for five minutes. The samples were allowed to condition for at least eight hours at 70 F/65 RH, prior to testing.

Samples were tested for float performance, in both the PU and PD configuration. For this test, a value of 100 indicated that the sample totally wet out in the water bath and sank to the bottom prior to the two minute internal being expired. A value of 50 indicated that the sample had wet out 50% the way up the tufts at the two minute measuring point. A value of 0 indicates that the sample did not wet out at all with water, and was essentially dry when removed from the water bath at the two minute point.

The samples were also testing for AR40 stain resistance using the AATCC 175 method, and the effect of dry soil exposure was tested using the same test method as described in earlier communications. Specific treatment composition parameters and testing results are provided in Table VII.

TABLE VII

Treatment Compositions and Testing Results

| | Dyebath SR | AT bath ATFB | AT Bath Acetic 56 | AT bath DSR | AT bath R3 | DL* | Decmc | AR40 | Flt PD | Flt PU |
|---|---|---|---|---|---|---|---|---|---|---|
| | >Ascend Acid Dyeable greige, Suessen Set, 40 oz cut pile | | | | | | | | | |
| | >Dyed into light yellow shade using Acid dyes (pH 5), then aftertreated as shown | | | | | | | | | |
| 2-1 | 0 | 0.00 | 0.00 | 0.00 | 0.00 | −35.05 | 13.75 | 1 | 100 | 100 |
| 2-2 | 4 | 0.75 | 2.00 | 4.00 | 0.75 | −28.06 | 11.07 | 10 | 0 | 0 |
| 2-3 | 0 | 3.00 | 2.00 | 4.00 | 0.75 | −27.75 | 11.11 | 10 | 100 | 100 |
| 2-4 | 0 | 3.00 | EX-2 | 0.00 | JA60-.5 | −27.37 | 10.78 | 10 | 10 | 10 |
| | >Dyed into light yellow shade using Vat dyes (pH 11.5), then aftertreated as shown | | | | | | | | | |
| 2-5 | 7 | 0.75 | 2.00 | 4.00 | 0.75 | −18.06 | 7.07 | 8 | 0 | 0 |

The tabulated data indicates the advantage for float test performance that results from adding stain resist material into the dyebath (Examples 2-2 and 2-5), so that the dyed fibers have an anionic charge, prior to contacting the fibers with the cationic, non-fluorinated, treatment bath. Sample 4 is a comparative example using conventional C6 fluorinated product (JA60), and Acid EX for exhaustion of this material onto the nylon fiber.

It is also notable that the vat dyed sample (2-5) produced by far the best soil release rating (DL* of −18.06 versus the untreated control at −35.05). This result was unexpected, and indicates that the system using nylon fibers that are acid dyeable, but dyed using a vat dyebath (with stain release chemistry as part of the vat dyebath, then after-treated with a non-fluorinated, protective chemical bath that contains a liquid repelling agent, a soil release agent, acid, and stain resist) produced excellent performance for all tests.

Example 4—Treatment and Performance of Nylon Carpets

Example 3 detailed the positive effect of including an effective amount of anionic stain resist chemistry into the dyebath, for acid dyeable nylon, prior to contacting the fiber with the cationic, non-fluorinated, protective treatment bath. It is believed that providing the acid dyeable nylon fibers with a charge state that is anionic in nature, provides for excellent exhaustion of the cationic, non-fluorinated, treatment chemistry when the protective treatment bath is applied.

The present example confirms that this effect can also be provided simply by dyeing the acid dyeable nylon fibers in conditions of high pH during the dye fixation process. These conditions are achieved when using the vat dyeing system designed for nylon fiber dyeing as described in PCT Patent Application Serial Number PCT/US2017/44897, which is incorporated herein by reference in its entirety. It is believed that the exposure of the acid dyeable fibers to the high pH bath, provides the fibers with an anionic charge state, or at least the cationic charge state normally present for amine end groups is neutralized. Under these conditions, excellent exhaustion of the cationic liquid repellent and soil repellent chemistry is achieved as evidenced in Table VIII.

TABLE VIII

Treatment Compositions and Testing Results

>Ascend Acid Dyeable greige, Suessen Set, 40 oz cut pile

>Dyed into medium gray shade using dyes as indicated, then after-treated as shown

| | Dyebath Type/pH | Dyebath SR | AT bath ATFB | AT Bath Acetic 56 | AT bath DSR | AT bath R3 | AR40 | Flt PD | Flt PU |
|---|---|---|---|---|---|---|---|---|---|
| 9-3 | Vat/pH 11.5 | 0 | 0.75 | 4.00 | 1.00 | 0.50 | 10 | 0 | 0 |
| 9-4 | Acid/pH 5 | 0 | 0.75 | 4.00 | 1.00 | 0.50 | 6 | 100 | 100 |

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A composition for treating fibers comprising:

an acidic aqueous or aqueous-based continuous phase; and a liquid repellent phase, the liquid repellent phase comprising a dendrimer component and/or non-dendrimer alkyl urethane, wherein the dendrimer component or non-dendrimer alkyl urethane are present in the composition in an amount of 0.5 to 6% on weight fiber (owf).

2. The composition of claim 1 having pH of 2.5 to 6.5.

3. The composition of claim 1 having pH of 3 to 4.

4. The composition of claim 1, wherein dendrimers of the dendrimer component comprise hydrophobic terminal residues.

5. The composition of claim 4, wherein the hydrophobic terminal residues are alkyl or alkenyl residues.

6. The composition of claim 1, wherein the dendrimer component or non-dendrimer alkyl urethane are present in the composition in an amount of 1 to 3% owf.

7. The composition of claim 1 further comprising at least one acid.

8. The composition of claim 7, wherein the at least one acid comprises a carboxylic acid.

9. The composition of claim 8, wherein the carboxylic acid comprises acetic acid or a derivative thereof.

10. The composition of claim 8, wherein the at least one acid is present in an amount of 0.2 to 2% owf.

11. The composition of claim 1, wherein the fibers are chemically modified with anionic functionalities.

12. The composition of claim 11, wherein the fibers are cationic dyeable nylon.

13. The composition of claim 1 further comprising an acid stain resist component.

14. The composition of claim 13, wherein the acid stain resist component imparts anionic character to the fibers.

15. The composition of claim 13, wherein the acid stain resist component is present in an amount of 0.5 to 6% owf.

16. The composition of claim 1 further comprising a soil release component.

17. The composition of claim 16, wherein the soil release component is present in an amount up to 6% owf.

18. A textile composition comprising:

fibers having a treatment composition applied to fiber surfaces, the treatment composition comprising an acidic aqueous or aqueous-based continuous phase, an acid stain resist component and liquid repellent phase comprising a dendrimer component and/or non-dendrimer alkyl urethane, wherein the dendrimer component or non-dendrimer alkyl urethane are present in the composition in an amount of 0.5 to 6% on weight fiber (owf).

19. The textile composition of claim 18, wherein dendrimers of the dendrimer component comprise hydrophobic terminal residues.

20. The textile composition of claim 19, wherein the hydrophobic terminal residues are alkyl or alkenyl residues.

21. The textile composition of claim 18, wherein the dendrimer component or non-dendrimer alkyl urethane are present in the treatment composition in an amount of 0.5 to 6% owf.

22. The textile composition of claim 18 further comprising an acid stain resist component.

23. The textile composition of claim 22, wherein the acid stain resist component is present in the treatment composition in an amount of 1 to 5% owf.

24. The textile composition of claim 18, wherein the fibers comprise anionic moieties.

25. The textile composition of claim 24, wherein the fibers are chemically modified with the anionic moieties.

26. The textile composition of claim 25, wherein the anionic moieties are provided by an acid stain resist component.

27. The textile composition of claim 25, wherein the fibers are cationic dyeable nylon.

28. The textile composition of claim 18, wherein the treatment composition further comprises a soil release component.

29. The textile composition of claim 18, wherein the fiber surfaces comprising the treatment composition extend at least 50 percent of fiber length.

30. The textile composition of claim 18, wherein the fiber surfaces comprising the treatment composition extend at least 80 percent of fiber length.

31. The textile composition of claim 18, wherein the fiber surfaces comprising the treatment composition extend over entire length of the fiber.

32. The textile composition of claim 18, wherein the fibers form a floor covering construction.

33. The textile composition of claim 32, wherein the floor covering is carpet.

34. The textile composition of claim 18, wherein the dendrimer component or non-dendrimer alkyl urethane are present in the composition in an amount of 1 to 3% owf.

* * * * *